United States Patent [19]

Johnston

[11] 4,333,511

[45] Jun. 8, 1982

[54] WINDOW INSULATIONS

[76] Inventor: David R. Johnston, Reading, England

[21] Appl. No.: 82,589

[22] Filed: Oct. 9, 1979

[30] Foreign Application Priority Data

Oct. 10, 1978 [GB] United Kingdom ..... 39979/78

[51] Int. Cl.[3] ..... E06B 9/20; E06B 9/208

[52] U.S. Cl. ..... 160/267 R; 160/271

[58] Field of Search ..... 160/267 R, 267 G, 268 R, 160/268 S, 271, 272, 269, 10, 270, 379; 49/490; 116/16

[56] References Cited

U.S. PATENT DOCUMENTS

| | | | |
|---|---|---|---|
| 695,049 | 3/1902 | Hill | 160/10 X |
| 2,009,917 | 7/1935 | Flanagan | 160/267 |
| 2,082,405 | 6/1937 | Lloyd et al. | 160/271 X |
| 2,361,762 | 10/1944 | Glenn et al. | 160/269 X |
| 2,509,398 | 5/1950 | Peremi et al. | 160/272 X |
| 2,523,839 | 9/1950 | McKinney | 49/490 X |
| 4,079,772 | 3/1978 | Klaenhammer et al. | 160/268 R |
| 4,117,465 | 9/1978 | Timblin | 340/545 |
| 4,160,972 | 7/1979 | LaMell et al. | 340/545 X |
| 4,194,550 | 3/1980 | Hopper | 160/121 R |
| 4,220,189 | 9/1980 | Marquez | 160/269 X |
| 4,258,517 | 3/1981 | Hammond | 160/269 X |

FOREIGN PATENT DOCUMENTS

| | | | |
|---|---|---|---|
| 1251480 | 10/1967 | Fed. Rep. of Germany | 160/267 |
| 2639275 | 6/1978 | Fed. Rep. of Germany | 160/271 |
| 836693 | 6/1960 | United Kingdom | 49/490 |

*Primary Examiner*—Rodney H. Bonck

*Attorney, Agent, or Firm*—Wenderoth, Lind & Ponack

[57] ABSTRACT

A thermal insulation arrangement for a door or a window comprises a transparent sheet drawn down from a spring-loaded roller at the top of the frame. The sides and preferably the base of the sheet are sealed by brush seals in channel-sectioned members. The sheet may be creased in a pattern to reduce rippling and billowing.

12 Claims, 8 Drawing Figures

FIG. 2
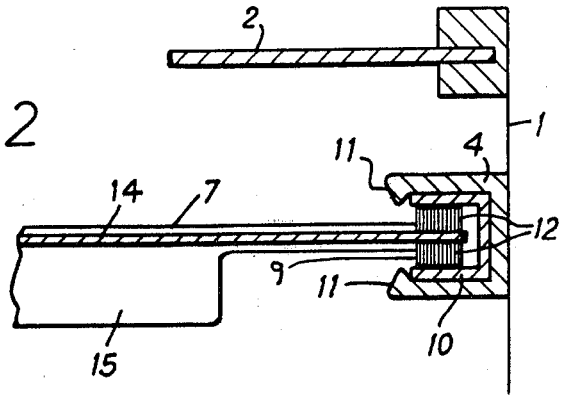
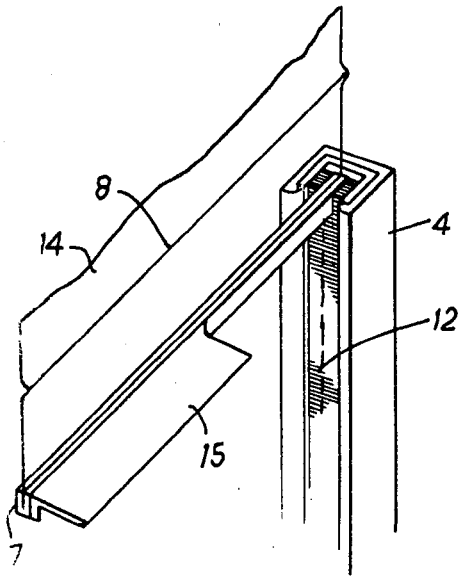
FIG. 3
FIG. 4
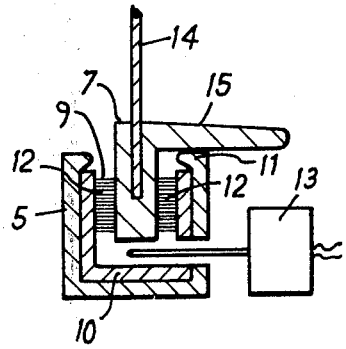

WINDOW INSULATIONS

The invention relates to heat insulation for windows or doors. The invention will be described hereinafter with particular reference to windows, but it is to be understood that the principles are applicable to the insulation of doors also.

There are two systems for double-glazing windows for heat insulation. The first, or so-called primary, system is to provide sealed window units comprising spaced panes of glass sealed in a frame to encapsulate an air cell which provides the heat insulation. Such units are generally fitted during building construction. Although it is possible to fit them as replacement windows, they are expensive.

The second system of double-glazing is the so-called secondary system and involves the fitting of a transparent sheet, usually of glass, within a window rebate so as to enclose, with the window, a volume of air which provides the thermal insulation. Unless an expensive secondary system is adopted, problems are presented in the summer-time when insulation is not required and when one wishes to open the window for ventilation. The transparent sheet may be removed, but then it must be stored.

Proposals have been made, for example, in U.S. Pat. No. 2,009,917 to provide a transparent flexible sheet on a spring-loaded roller. This avoids the problem of removal and storage but introduces other problems. For example a sheet which is flexible enough to wind on a roller is generally thin and fragile. The free end of the sheet is susceptible to damage and requires stiffening and protection with a bar or the like. This means that the stiffening bar passes through any side seals which are normally required to seal against the faces of the thin sheet. No satisfactory side-sealing arrangement has been suggested hitherto to overcome this problem. The present invention seeks to provide an improved insulation arrangement.

According to the invention there is provided a thermal insulation arrangement for a window or door in a frame, the arrangement comprising a spring-loaded roller mounted across the top of the frame, a flexible sheet wound on the roller of such a shape and size as to fill the frame when drawn down from the roller, a stiffening bar along the free end of the sheet, channel members mounted down the sides of the frame, and flexible plastics brush seals mounted in the channel members, the brush seals being effective to seal against both faces of the sheet at the side edges and allow passage of the stiffening bar.

Preferably the brush seals are of polypropylene.

It is desirable to provide a seal at the bottom edge of the frame also. In accordance with a preferred feature of the invention this is provided by a base channel member fixed across the bottom of the frame and housing a flexible plastics brush seal. Preferably the seal is of polypropylene. This arrangement has the advantage that by selection of the channel width and brush properties the bottom seal will hold the stiffening bar against the spring tension in the roller, so that no special catch mechanism is required. Also, the depth of the channel and brushes will accommodate misalignment of the bar as might result from the frame being not perfectly rectilinear, for example.

The provision of brush side seals allows the use of a preferred feature of the invention. Thus, preferably the sheet is creased from side to side at one or more places. Such creasing stiffens the sheet and helps prevent the sheet blowing out of the side channels as a result of sudden pressure changes. The brush seals seal against the shape of the crease or creases at the edges.

Preferably the sheet is of plastics material and preferably it is transparent. However, for special purposes the sheet may be translucent or opaque. The sheet may be coloured.

In practice it is found that sometimes the plastics sheet can become distorted slightly by thermal expansion, for example, or perhaps by pressure fluctuations. Although such distortions can be very slight, they are sometimes easily visible because of reflection from the sheet.

It is found that by appropriate creasing of the sheet these effects can be reduced or obviated. Thus, preferably the sheet is creased or embossed in lines in such a way as to sub-divide the area of the sheet to adjacent sections so that distortions of the sheet are not readily transmitted from section to section and are thus localized.

In one simple embodiment of the invention the sheet is creased with two paralled horizontal lines running near the stiffening bar. The stiffening bar is generally made of aluminum and differential thermal expansion of the plastics material with respect to the aluminium has been found to result in visible distortion at the draw-bar since the draw bar clamps the sheet tightly. Attempts to avoid this effect by providing cushioned clamping have not met with success. Also, the provision of a single crease near the draw-bar, while reducing the effect to some extent, does not entirely solve the problem. It is found, however, that a pair of parallel creases provides a section between the creases which effectively isolates the rest of the sheet from the effects of puckering at the draw-bar. Typically, the parallel creases run one to two inches apart.

Another embodiment of the present invention provides a set of parallel creases over the surface of the blind, either horizontal, vertical, diagonal or perhaps curved.

Another, and preferred, embodiment of the present invention provides the sheet with a grid of crossed creases which define enclosed sections. The creases may be curved but are preferably straight. The grid may be simply two sets of parallel straight creases, the sets crossing at right angles, thereby defining square or oblong sections. It is found with this arrangement that the adjacent sections are more or less independent as far as the effects of distortions are concerned. Local distortions are restricted by the creases and are not transmitted across the sheet. Thus, the visual effects of puckering at the draw-bar and billowing due to pressure fluctuations are to a large extent reduced. The creases themselves are light enough as to be virtually invisible.

As used herein "crease" generally means a shallow 'V'-shaped indented groove. However, the desired effect can be obtained by shallow 'U'-shaped or square-sectioned indented grooves which can be achieved by embossing. The grooves may be made by running wheels of suitable cross-section across the sheet. Local heat may be applied to assist the formation of the grooves.

Successive creases of a set of parallel creases may be made in opposite direction in "concertina" fashion.

Preferably the parallel creases, whether in a single set or a pair of crossed sets, are spaced apart less than 25 cm, and preferably more than 2 cm.

A preferred modification of a transparent sheet for use in accordance with the invention is to provide it with a part-reflective layer. This may be produced by a flash metallizing process. In the winter, this will provide protection against a certain amount of radiant heat loss and in the summer it can reflect incoming radiation and thus help keep the interior of the building cool. This system of insulation also has the advantage that it can incorporate an intruder alarm. To gain access via a window or door insulated in the manner described, an intruder must penetrate the sheet. A microswitch can be fitted to the roller or to the bottom channel, for example, so arranged as to activate a burglar alarm if the sheet is raised.

The invention will further be described with reference to the accompanying drawings, of which:

FIG. 2 is a cross-section taken at 'A–A' of FIG. 1;

FIG. 3 is a perspective view of part of one side of the arrangement of FIGS. 1 and 2;

FIG. 4 is a cross-section taken at 'B–B' of FIG. 1;

Figure 1:
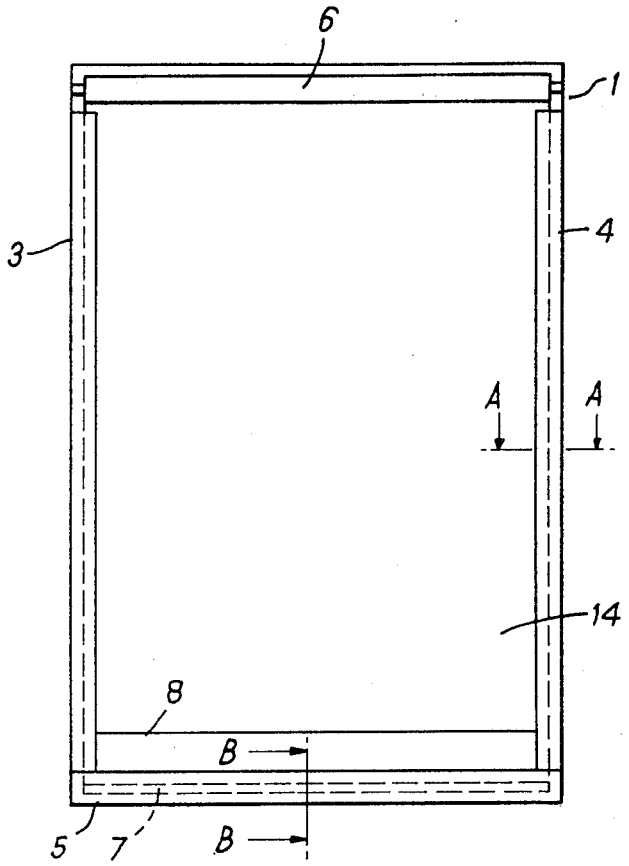
FIG. 1 is an elevation of a window incorporating an insulation arrangement in accordance with the invention.

Referring to the drawings there is shown a window-frame 1 in which is fitted a window 2 (FIG. 2). Channel-section side members 3, 4 of extruded aluminum are screwed to respective sides of the frame 1 to extend from top to bottom. A base member 5, also of channel section and made from extruded aluminium, is screwed along the bottom of the frame.

At the top of the frame is mounted a spring-loaded roller 6 on which is wound a sheet 14 of transparent plastics material. The free end of the sheet 14 is clamped in an aluminium stiffening bar 7. Bar 7 has a grip 15 extending along the major part of the bar on the inside. This allows the bar to be drawn down by hand. The grip terminates short of each end of the bar. The sheet is strengthened by forming in it a crease 8 parallel to the bar 7.

Sealing of the sheet with respect to the window frame is achieved at the sides and bottom by brush seals such as that shown at 9 in FIG. 2. The seal is made of polypropylene and comprises a backing 10 of channel section which fits into and is held by the side member 3 by virtue of lips 11. Soft and flexible brushes 12 of polypropylene fibres extend inwardly from the backing and meet across the mouth of the channel and seal against the sheet when the sheet is drawn down. The brushes allow the stiffening bar 7 to pass and also accommodate and seal the crease 8, as shown in FIG. 3.

FIG. 4 shows the sealing brushes 9 in the base member. These are arranged to hold the bar 7 and retain it against the tension of the spring in the roller 6. When the bar 7 is released from the seal in the channel 5, the spring draws the sheet up. In FIG. 4 a microswitch 13 is shown. This is engaged by the bar 7 when the sheet is drawn down. When the sheet is released the microswitch senses this and provides a signal to a burglar alarm circuit (not shown). This is a convenient way to arrange an intruder detection system.

Although further brush seals may be used at the top of the frame to seal against the sheet near the roller, it is preferred not to use seals here, but to allow a gap. This allows air to enter and leave the enclosure via the top if there are pressure changes. However, under normal circumstances the enclosed air will be retained since it is cooler and thus heavier than the air in the room.

Figure 5:
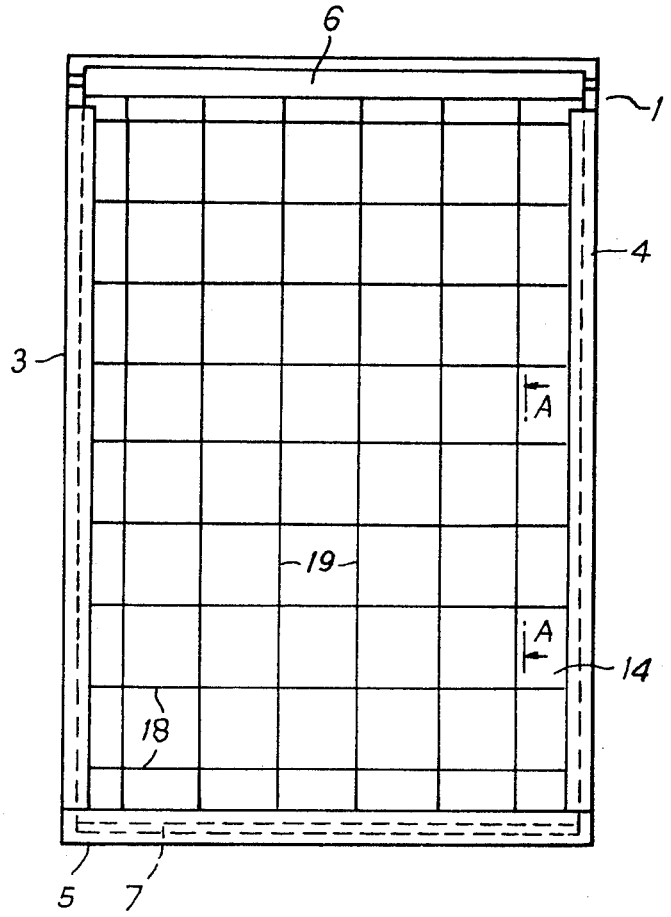
FIG. 5 is an elevation of an embodiment of the invention showing a pattern of creases.

Referring to FIG. 5 there is shown a sheet having a particular pattern of creases. The sheet is made of polyester terepthalate, conveniently of the kind marketed under the name "Melinex" (Registered Trade Mark). Typically, the sheet is of a thickness of 0.004" or 0.005".

Figure 6:
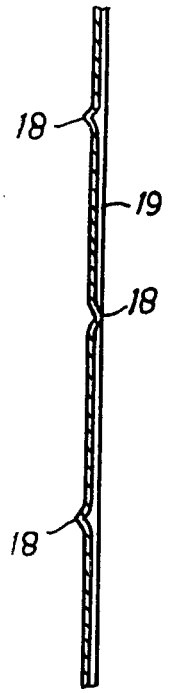
FIG. 6 is a scrap cross-section at 'A–A' of FIG. 5.

As shown in FIG. 5 the sheet is formed with a first set of horizontal creases 18 and a second set of vertical creases 19. The creases of each set are spaced apart in this example by 5 cm, thus defining squares of side 5 cm. As shown in FIG. 6 the creases are very shallow 'V'-shaped creases made in alternate directions in "concertina" fashion. The scale of the creases in FIG. 6 is greatly exaggerated for the purpose of illustration.

Figure 7:
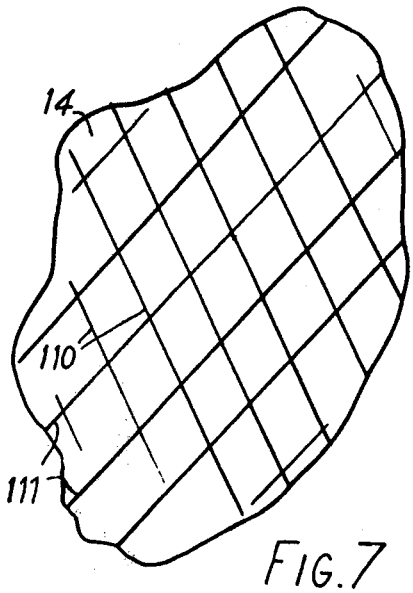
FIG. 7 is an elevation of part of a sheet for use in the invention embodying another pattern of creases.

FIG. 7 shows an alternative pattern of creases, in this case diagonal creases 110, 111 which define diamond-shaped regions.

In FIGS. 5 and 7 there are shown arrangements with two crossed sets of creases. It is to be understood that the invention can be put into effect by omitting one set of parallel creases. Thus, in FIGS. 5 and 6 set 18 or set 19 may be omitted. In FIG. 3 set 110 or set 111 may be omitted.

Figure 8:
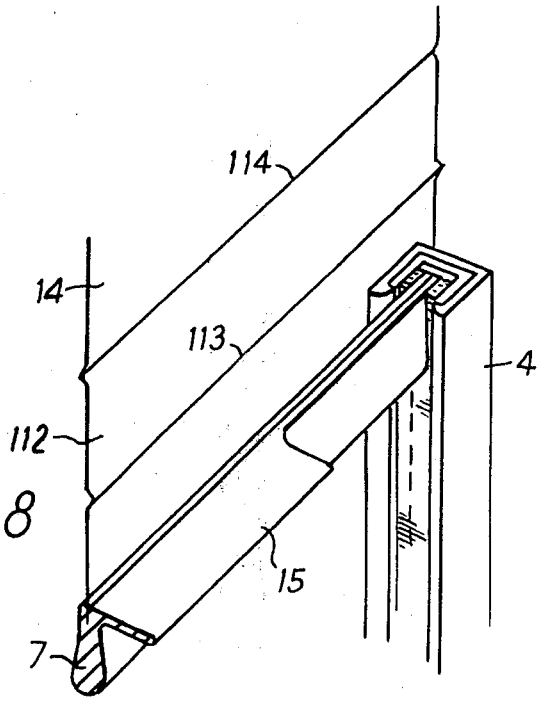
FIG. 8 is a diagram showing another arrangement of creases in a sheet for use in accordance with the invention.

FIG. 8 shows an arrangement in accordance with the invention in which a horizontal region 112 of the sheet is defined by two parallel creases 113, 114. Crease 113 is about 2 cm from the draw-bar and crease 114 is about 2 cm from crease 113. This configuration helps prevent the effects of puckering of the sheet at the draw-bar, and may be provided in accordance with the invention above or in combination with a grid of creases as shown in FIG. 5 or FIG. 7.

What I claim is:

1. A thermal insulation arrangement for a window or door in a frame, the arrangement comprising a spring-loaded roller mounted across the top of the frame, a flexible sheet wound on the roller of such a shape and size as to fill the frame when drawn down from the roller, a stiffening bar along the free end of the sheet, channel members mounted down the sides of the frame, and flexible plastic brush seals mounted in the channel members, wherein said stiffening bar is respectively extended into said channel members between the brush seals, the brush seals respectively slidably engaging both faces of the sheet at the side edges thereof for air sealing between the respective brush seals and the respective faces of the sheet at the side edges thereof and for allowing passage of the stiffening bar between the respective brush seals.

2. A thermal insulation arrangement for a window or door in a frame, the arrangement comprising:

a spring loaded roller mounted across the top of the frame;

a flexible sheet wound on the roller of such a shape and size as to fill the frame when drawn down from the roller;

wherein said sheet is creased in lines for sub-dividing the area of said sheet into adjacent sections for, when at least one section of said sheet becomes distorted, substantially preventing the distortions of at least one section from being readily transmitted from section to section whereby the distortions are localized;

a stiffening bar along the free end of said sheet;

channel members mounted down the sides of the frame;

flexible plastic brush seals mounted in said channel members; and said brush seals respectively slidably engaging both faces of said sheet at the side edges thereof for air sealing between the respective brush seals and the respective faces of said sheet at the side edges thereof and for allowing passage of said stiffening bar between the respective brush seals.

3. A thermal insulation arrangement as claimed in claim 1 wherein there is provided a base channel member fixed across the bottom of the frame and a flexible plastic brush seal in the base channel member, this seal being arranged to retain the stiffening bar against the roller spring tension.

4. A thermal insulation arrangement as claimed in claim 3 or 1 wherein the brushes are made of polypropylene.

5. A thermal insulation arrangement as claimed in claim 1 wherein the sheet is creased from side to side at one or more places.

6. A thermal insulation arrangement as claimed in claim 1, wherein the sheet is creased in lines in such a way as to sub-divide the area of the sheet to adjacent sections so that distortions of the sheet are not readily transmitted from section to section and are thus localized.

7. A thermal insulation arrangement as claimed in claim 6 or 2 wherein the sheet is creased with two paralled horizontal lines running near the stiffening bar.

8. A thermal insulation arrangement as claimed in claim 6 or 2 wherein the sheet is provided with a grid of crossed creases which define enclosed sections.

9. A thermal insulation arrangement as claimed in claim 1 wherein the sheet is of transparent plastics material provided with a part-reflective coating.

10. A thermal insulation arrangement as claimed in claim 1, wherein the sheet is embossed in lines for subdividing the area of the sheet into adjacent sections so that distortions of the sheet are not readily transmitted from section to section and are thus localized.

11. A thermal insulation arrangement as claimed in claim 1, wherein a base channel member is fixed across the bottom of the frame and a microswitch is situated adjacent to said base channel member for being in contact with the stiffening bar when the sheet is situated in said base channel member whereby when the stiffening bar is removed from said base channel member the microswitch is actuated.

12. A thermal insulation arrangement for a window or door in a frame, the arrangement comprising:

a spring loaded roller mounted across the top of the frame;

a flexible sheet wound on the roller of such a size and shape as to fill the frame when drawn down from the roller;

wherein said sheet is creased from side to side at at least one place for substantially reducing distortions in the sheet;

a stiffening bar along the free end of said sheet;

channel members mounted down the sides of the frame;

flexible plastic brush seals mounted in said channel members; and said brush seals respectively slidably engaging both faces of said sheet at the side edges thereof for air sealing between the respective brush seals and the respective faces of said sheet at the side edges thereof and for allowing passage of said stiffening bar between the respective brush seals.

* * * * *